United States Patent [19]

Kintz

[11] 4,002,894

[45] Jan. 11, 1977

[54] LIGHTING FIXTURE WITH A DIAGONALLY ARRANGED LAMP

[75] Inventor: Harry Kintz, Traunreut, Germany

[73] Assignee: Siemens Aktiengesellschaft, Munich, Germany

[22] Filed: Apr. 7, 1975

[21] Appl. No.: 565,955

[30] Foreign Application Priority Data

Apr. 8, 1974 Germany ..... 2417100
Feb. 27, 1975 Germany ..... 2508580

[52] U.S. Cl. ..... 240/11.2 A; 240/41.35 E; 240/103 R

[51] Int. Cl.[2] ..... F21L 7/00; F21Y 7/00

[58] Field of Search ..... 240/11.2 A, 11.4 A, 240/41.35 E, 41.36, 103 R, 104, 41.35 F

[56] References Cited

UNITED STATES PATENTS

| | | | |
|---|---|---|---|
| 1,788,910 | 1/1931 | Buttolph | 240/103 R UX |
| 2,789,245 | 4/1957 | Strong et al. | 240/103 R X |
| 3,059,106 | 10/1962 | Moser | 240/78 |
| 3,433,941 | 3/1969 | Hall | 240/41.36 |

*Primary Examiner*—George H. Miller, Jr.
*Attorney, Agent, or Firm*—Kenyon & Kenyon Reilly Carr & Chapin

[57] ABSTRACT

An essentially rotationally symmetrical light distribution pattern in the horizontal plane is achieved using a lighting fixture having a reflector in the form of a truncated pyramid with a high pressure discharge lamp having a linear arc arranged so that the principal radiation directions from the lamp which are perpendicular to the longitudinal axis of the arc point toward opposite corners of the reflector.

7 Claims, 2 Drawing Figures

LIGHTING FIXTURE WITH A DIAGONALLY ARRANGED LAMP

BACKGROUND OF THE INVENTION

This invention relates to lighting fixtures for discharge lamps having high brightness and linear arcs in general and more particularly to an improved lighting fixture of this nature which achieves almost complete rotational symmetry of the light distribution pattern.

A lighting fixture for a dischage lamp having high brightness and having a linear arc and which has a reflector in the form of a truncated pyramid with a rectangular light egress opening is disclosed in U.S. Pat. No. 3,433,941. In this lamp, which has a square light egress opening, a mercury vapor discharge lamp is arranged so that its axis extends parallel to one side of the light egress opening. With a design of this nature, substantial deviations from a rotationally symmetrical light distribution must be tolerated. However, in many applications such is undesirable. In view of this, it is the object of the present invention to provide an improved lighting fixture of this nature which retains the advantages associated therewith and at the same time provides an essentially rotationally symmetrical light distribution pattern in the horizontal plane [essentially the same light distribution in all vertical planes].

SUMMARY OF THE INVENTION

The present invention achieves this object by having the arc of the discharge lamp, i.e. by having the inner bulb containing the arc, arranged so that the principal radiation directions of the lamp perpendicular to a longitudinal axis of the arc point toward opposite corners of the reflector. To accomplish this the inner bulb is arranged in a plane extending perpendicular to the light egress opening and is arranged diagonally between two diametrically opposed corners of the light egress opening.

Through this arrangement, each reflector side obtains approximately one-quarter of the total radiation and the minima of the light distribution curve of the lamp point toward the optically less favorable corners. A surprisingly favorable light distribution characteristic is obtained particularly when using a lamp having a clear glass tubular outer bulb with a ratio of the optically effective [luminous] inner bulb length [distance between electrodes] to the diagonal of the light egress opening of 0.08 to 0.17. This remains the same even if the lamp is moved in the vertical lamp plane in order to achieve deep or broad radiating light distributions and is not particularly affected even if the lamp has bases on both sides.

The present invention has an additional advantage the fact that the socket or sockets of the lamp with the necessary cutouts in the reflector can be arranged in the corner regions which, from the illumination standpoint, are least effective thereby achieving optimal utilization of the optically effective reflector surface and an increase in the efficiency of the lighting fixture. Furthermore, small cutouts in the reflector are sufficient for lamp sockets and a more advantageous physical arrangement for accommodating series connected devices and other accessories above the reflector is created.

DETAILED DESCRIPTION OF THE PREFERRED EMBODIMENT

Figure 1:
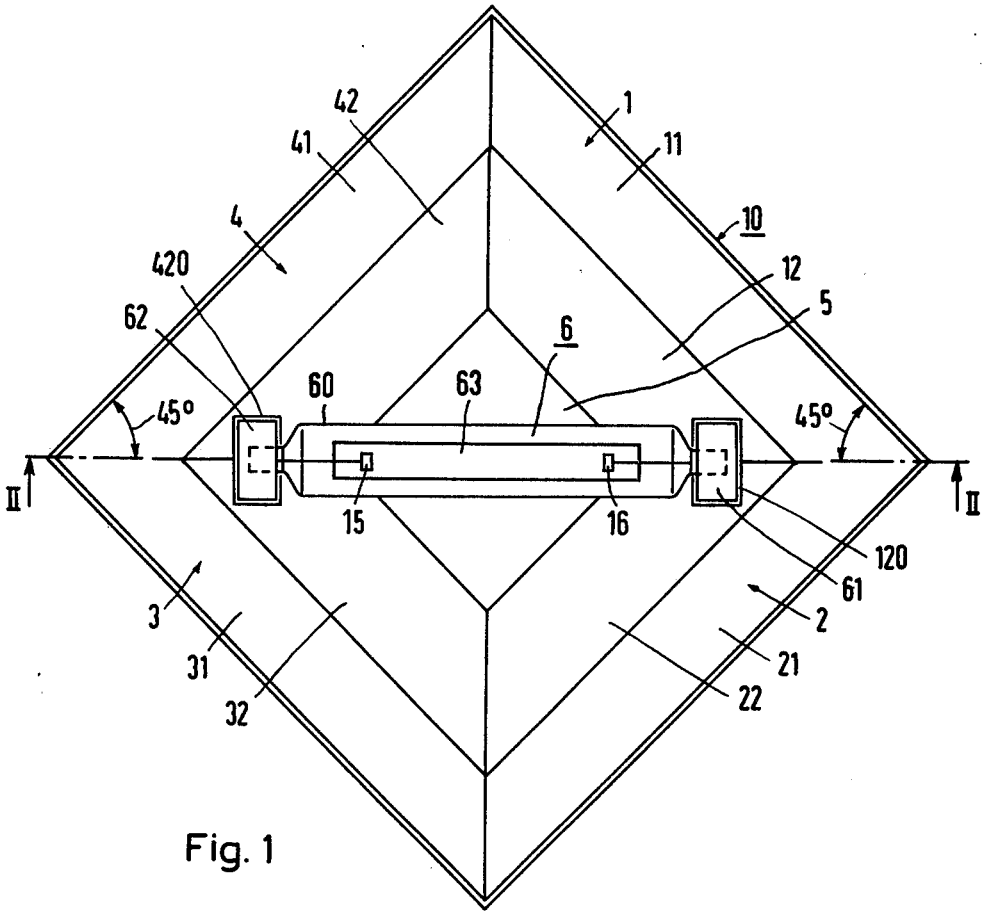
FIG. 1 is a view of the lighting fixture of the present invention from below along the direction of the arrow I of FIG. 2.
Figure 2:
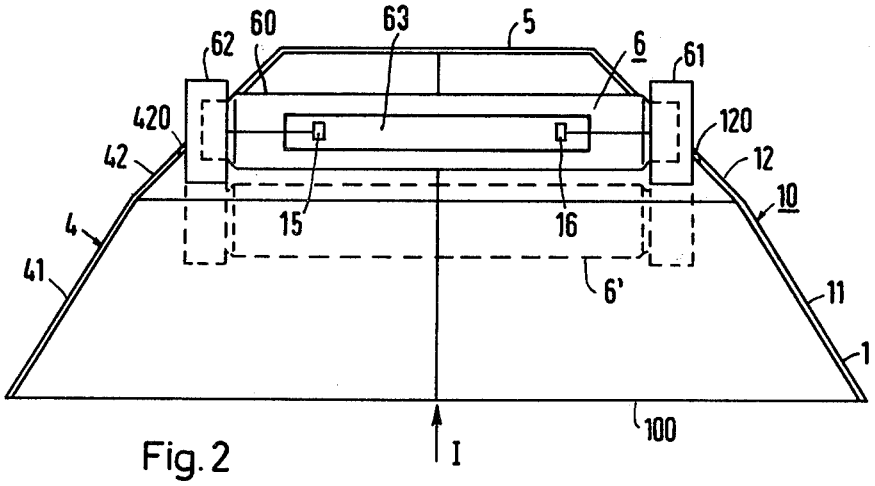
FIG. 2 is a cross section along the line II—II of FIG. 1.

The light fixture of the present invention illustrated on FIGS. 1 and 2 include a reflector 10 in form of two truncated pyramids with different angles. The lower truncated pyramid is formed by flat sheet metal strips 11, 21, 31 and 41. The upper truncated pyramid is formed of the flat metal strips 12, 22, 32 and 42. All of these surfaces making up the reflector 10 will preferably have mirror surfaces. The reflector is closed off on the top by a cover sheet 5 disposed parallel to the light egress opening 100 of the reflector. Cover sheet 5 may have a mirror-like reflecting surface or a diffuse reflecting surface. It is preferable that the sides 1, 2, 3 and 4 of the reflector 10 be made of a single piece of sheet metal each, i.e. the aforementioned strips 41 and 42, for example, would be of a single sheet of metal properly bent. In such a case, the cover sheet 5 may be integral with one of the side pieces. The individual sides are connected to each other at the joints in any well known manner such as cementing, riveting, beading or the like.

The discharge lamp 6 illustrated will preferably be a metal halogen discharge lamp with two bases, a clear glass tubular outer bulb 60 and inner bulb 63 in which the arc is formed. What is meant by a metal halogen discharge lamp is a lamp of the type described in Standard Handbook for Electrical Engineers, 10th Edition, edited by D. C. Fink and J. M. Carrol, Sec. 19–28, and page 19—19. It will be recognized that other types discharge lamps such as a conventional mercury discharge lamp may be used. Within the inner bulb 63 are electrodes 15 and 16 between which the arc will burn. As indicated above, it is preferable that the ratio between the effective arc length, i.e. the distance between electrodes 15 and 16 and the diagonal of the light egress opening is between 0.08 and 0.17. In accordance with the present invention, the discharge lamp 6 is arranged in a lamp plane extending perpendicular to the light egress opening 100 with the lamp 6 extending diagonally between two corners of the reflector 10. The sockets 61 and 62 which retain the bases of the lamp are preferably mounted for vertical motion in conventional fashion so that the lamp can be shifted between the positions shown in solid and dotted lines. By shifting to this latter, i.e. the one shown in dotted lines a broadly radiating light distribution can be obtained. The cutouts 120 and 420 for the sockets 61 and 62 are located in the corner regions of the reflector and thus do not materially interfere with light reflection.

Thus, an improved lighting fixture for a discharge lamp with high brightness and a linear inner bulb containing an arc has been shown. Although a specific embodiment has been illustrated and described, it will be obvious to those skilled in the art that various modifications may be made without departing from the spirit of the invention which is intended to be limited solely by the appended claims.

What is claimed is:

1. In a lighting fixture for discharge lamp of high brightness, said lamp being of the type having a linear inner bulb containing a burning arc, with a reflector in the form of a truncated pyramid with a rectangular light egress opening, the improvement comprising means for supporting the discharge lamp within the reflector so that the principal radiation directions of the lamp which are perpendicular to the longitudinal axis of the inner bulb point toward two diametrically opposed corners of the reflector.

2. A light fixture according to claim 1 wherein said light egress opening is square.

3. A lighting fixture according to claim 1 wherein the discharge lamp has a clear glass outer bulb and wherein the ratio of the optically effective arc length to the diagonal of the light egress opening of the reflector is between 0.08 and 0.17.

4. A lighting fixture according to claim 3 wherein said discharge lamp has bases on both sides.

5. A lighting fixture according to claim 4 wherein the axis of the arc of the lamp is parallel to the plane of the light egress opening.

6. A lighting fixture according to claim 3 wherein the axis of the arc of the lamp is parallel to the plane of the light egress opening.

7. A lighting fixture according to claim 6 wherein said light egress opening is square.

* * * * *